US005792260A

United States Patent [19]

Rantanen et al.

[11] Patent Number: 5,792,260

[45] Date of Patent: Aug. 11, 1998

[54] METHOD AND EQUIPMENT FOR TWO-SIDED COATING OF A PRINTING PAPER WEB

[75] Inventors: Rauno Rantanen, Muurame; Pekka Haapanen, Järvenpää, both of Finland

[73] Assignee: Valmet Corporation, Helsinki, Finland

[21] Appl. No.: 578,581

[22] PCT Filed: Apr. 18, 1995

[86] PCT No.: PCT/FI95/00221

§ 371 Date: Mar. 19, 1996

§ 102(e) Date: Mar. 19, 1996

[87] PCT Pub. No.: WO95/28522

PCT Pub. Date: Oct. 26, 1995

[30] Foreign Application Priority Data

Apr. 19, 1994 [FI] Finland ..... 941803

[51] Int. Cl.[6] ..... B05C 1/04; B05D 5/04; B05D 3/02

[52] U.S. Cl. ..... 118/217; 118/220; 118/226; 118/227; 118/261; 118/407; 118/413; 427/211; 427/356; 427/359; 427/382

[58] Field of Search ..... 427/211, 382, 427/411, 209, 356, 359; 118/210, 216, 217, 220, 223, 226, 227, 244, 255, 261, 407, 410, 411, 413

[56] References Cited

U.S. PATENT DOCUMENTS

| | | | |
|---|---|---|---|
| 2,758,036 | 8/1956 | Cyr | 427/211 |
| 3,231,418 | 1/1966 | Muggleton | 427/211 |
| 3,911,174 | 10/1975 | Rose | 427/211 |
| 4,076,864 | 2/1978 | Wallstén | 427/211 |
| 4,177,304 | 12/1979 | Berry | 427/211 |
| 4,354,449 | 10/1982 | Zink | 427/211 |
| 4,357,370 | 11/1982 | Alheid | 427/211 |
| 4,363,833 | 12/1982 | Blaak | 427/211 |
| 4,478,887 | 10/1984 | Sommer et al. | 427/211 |
| 4,657,783 | 4/1987 | Tatt et al. | 427/211 |
| 4,700,658 | 10/1987 | Beisswanger et al. | 118/67 |
| 4,822,640 | 4/1989 | Tuhkanen et al. | 427/211 |
| 5,159,893 | 11/1992 | Rantanen | 118/227 |

FOREIGN PATENT DOCUMENTS

| | | |
|---|---|---|
| 0596365 | 5/1994 | European Pat. Off. . |
| 854252 | 5/1986 | Finland . |
| 922331 | 11/1993 | Finland . |
| 924960 | 5/1994 | Finland . |
| 925704 | 6/1994 | Finland . |
| 941756 | 10/1994 | Finland . |
| 4302437 | 8/1993 | Germany . |

*Primary Examiner*—Diana Dudash

*Attorney, Agent, or Firm*—Steinberg, Raskin & Davidson, P.C.

[57] ABSTRACT

The invention concerns a method for two-sided coating of a printing-paper web with a coating paste or equivalent. In the method, the paper web is passed through the coating part of the paper machine, in which the first side of the web is coated in the first coating station of said coating part, and the coating-agent layer produced on the face of the web is dried at least partly by means of a first drying unit. The second side of the web is coated in the second coating station of the coating part, and the second coating-agent layer produced on the face of the web is dried at least partly by means of a second drying unit. The coating-agent layers are formed onto the paper web alternatively by spreading the necessary amount of coating agent by means of a coating device as a film onto the face of a film press roll, from which the coating agent is transferred in the nip between the film press roll and the back-up roll as a coating-agent layer onto the paper web, or by forming the coating-agent layer directly onto the paper web by means of a blade coating device that coats the web face while using one of the film press rolls as the back-up rolls of the blade coating devices.

19 Claims, 5 Drawing Sheets

METHOD AND EQUIPMENT FOR TWO-SIDED COATING OF A PRINTING PAPER WEB

FIELD OF THE INVENTION

The invention concerns a method for two-sided coating of a printing-paper web with a coating paste or equivalent, in which method the paper web is passed through the coating part of the paper machine, in which the first side of the web is coated in the first coating station of said coating part, and the coating-agent layer produced on the face of the web is dried at least partly by means of a first drying unit fitted after the first coating station, and in which method the second side of the web is coated after the first drying unit in the second coating station of the coating part, and the second coating-agent layer produced on the face of the web is dried at least partly by means of a second drying unit fitted after the second coating station.

Further, the invention concerns an equipment for two-sided coating of a printing-paper web with a coating paste or equivalent in a coating part of a paper machine, which equipment comprises a first coating station for the coating of the first side of the web and a first drying unit, fitted after the first coating station, for at least partial drying of the coating-agent layer produced in the first coating station, as well as a second coating station, fitted after the first drying unit, for the coating of the second side of the web and a second drying unit, fitted after said second coating station, for at least partial drying of the coating-agent layer produced in the second coating station.

BACKGROUND OF THE INVENTION

Traditionally, printing-paper webs are coated by means of various blade or bar coaters. A problem especially with thin printing-paper webs has been poor runnability. The quality of the coating in particular in respect of smoothness is good when blade or bar coaters are used.

In the Finnish Patent Application No. 924960, a method and an equipment are described for two-sided coating of a thin printing-paper web that contains mechanical pulp, which method and equipment were taken to production operation at the beginning of the year 1994. In said new method, the coating agent is first metered onto the face of the film roll of a film press and transferred further onto the paper in the nip between the rolls in the film press. The first side of the web is coated in a first coating station, after which the first coating layer that was formed is dried, and the second side of the web is coated in a second coating station. In respect of the runnability, the new method and equipment have fulfilled the expectations well.

In thin paper grades, with the method described above, the quality of the coating is highly competitive with corresponding blade-coated grades. With higher grammages of the web, in particular by means of a blade coating equipment provided with an applicator roll or equivalent, it is possible to run larger coating quantities than with a film press and, thus, also a printing paper of a clearly higher quality.

In the FI Laid-Open Publication No. 79,954, an equipment is described by whose means the paper web can be coated from both sides by alternatively using either the film press technique or coating applied directly onto the web. The aim of said publication is to utilize one film press unit, by whose means both sides of the web are coated. In the method in accordance with said publication, however, no attention has been paid to the coating of a thin web of low strength. Further, it is a drawback of this solution that, when the mode of coating is changed, the draw of the web becomes completely different, and, further, the construction has been accomplished so that, when film-press coating is used, the heaters that are used in order to dry the web on application of the coating directly onto the web are fully unnecessary.

OBJECTS AND SUMMARY OF THE INVENTION

The object of the present invention is to eliminate the deficiencies in the prior-art methods described above and to provide a novel and versatile method and equipment for two-sided coating of a printing-paper web.

In view of achieving the objectives of the invention, the method in accordance with the invention is mainly characterized in that the coating-agent layers are formed onto the paper web alternatively by spreading the necessary amount of coating agent by means of a coating device as a film onto the face of a film press roll, which revolves at a circumferential speed substantially equal to the web speed, from which roll the coating agent is transferred in the nip between the film press roll and the back-up roll as a coating-agent layer onto the paper web, or by forming the coating-agent layer directly onto the paper web by means of a blade coating device that coats the web face while using one of the film press rolls as the back-up rolls of the blade coating devices.

On the other hand, the equipment in accordance with the invention is mainly characterized in that each coating station comprises a film press coating unit consisting of a film roll with its metering device and of a back-up roll, at least one of which rolls is provided with at least one coating device, the coating units being alternatively usable either for film press coating, in which the coating device is arranged to spread the necessary amount of coating agent as a film onto the face of the film press roll, which revolves at a circumferential speed substantially equal to the web speed, from which roll face the coating agent is fitted to be transferred in the nip between the film press roll and the back-up roll as a coating-agent layer onto the paper web, or for blade coating, in which the blade coating device is arranged to form a layer of coating agent directly onto the web, which is passed over the film press roll so that said film press roll operates as a back-up roll for the coating device.

By means of the present invention, compared with the prior art, several advantages are obtained, of which, among other things, the following might be stated.

In the method in accordance with the present invention, thin paper grades are, as a rule, coated by means of the film press technique, and thicker paper grades are coated by means of the blade coating technique. Depending on the desired quality of the paper, the division can also be such that grades of lower quality are run by means of a film press and paper grades of higher quality are run by means of a blade coating equipment.

The difference in the quality of coating between the film press and blade coating methods is illustrated in FIG. 1. In FIG. 1, the left side illustrates the blade coating technique, in which the paper web W is passed over a roll 42 provided with a coating 43. The roll 42 forms a back-up roll for the blade applicator 41, by whose means the coating agent is spread and evened directly onto the face of the paper web W as a coating 44. The right side of FIG. 1 illustrates the film press technique, in which the paper web W is passed through a nip N formed by rolls 52, **52*a* provided with coatings 53, 53*a*. By means of the applicator devices 51, 51*a*, the coating agent is spread as films F,Fa onto the faces of the film press rolls 52, 52***a*, from which it adheres to the paper web W in the nip N between the rolls and forms the coatings 54, 54*a* on the web faces. As can be seen from the enlarged sectional views of the paper, by means of the blade coating technique, a better smoothness of the paper is achieved, whereas, by means of the film press technique, coating layers of uniform thickness are obtained, whose advantages are uniform properties of absorption of printing ink and possibility of coating of a base paper of relatively poor brightness without resulting patches in the coating. In the method of the present invention, the running modes can also be chosen based on these reasons. Practice has proved that, among other things, owing to lack of space, on one hand, and owing to high investment costs, on the other hand, it is difficult to carry out, for example, the drying required by the coating. Thus, it is not rational to use a separate film press unit and a separate blade coating unit in the same coating equipment in order to produce a different final product of different type, i.e. a different coating paper. The present invention also provides a usable and favourable solution for this problem.

Thus, by means of the method and the equipment in accordance with the present invention, it is flexibly possible to produce all the paper grades permitted by the customary present-day techniques while optimizing the quality of the paper and the runnability of the coating process.

In addition to the fact that the method and the equipment in accordance with the present invention are suitable for two-sided coating of a base paper, as was stated above, the paper web may, of course, also have been pre-coated, for example, by means of a film press before the two-sided coating in two stages taking place by means of the method in accordance with the invention.

Further, in the present invention, it is possible that the paper is coated or surface-sized from both sides, for example, by means of the first coating unit (film press unit) placed in the first coating station of the equipment, in which case the second film press unit placed in the second coating station is not used, or one-sided coating of the web is carried out by means of said second unit.

BRIEF DESCRIPTION OF THE DRAWINGS

The further advantages and characteristic features of the invention will come out from the following detailed description of the invention, in which the invention will be described by way of example with reference to the figures in the accompanying drawings 1–5.

DETAILED DESCRIPTION OF THE PREFERRED EMBODIMENTS

Figure 1B:
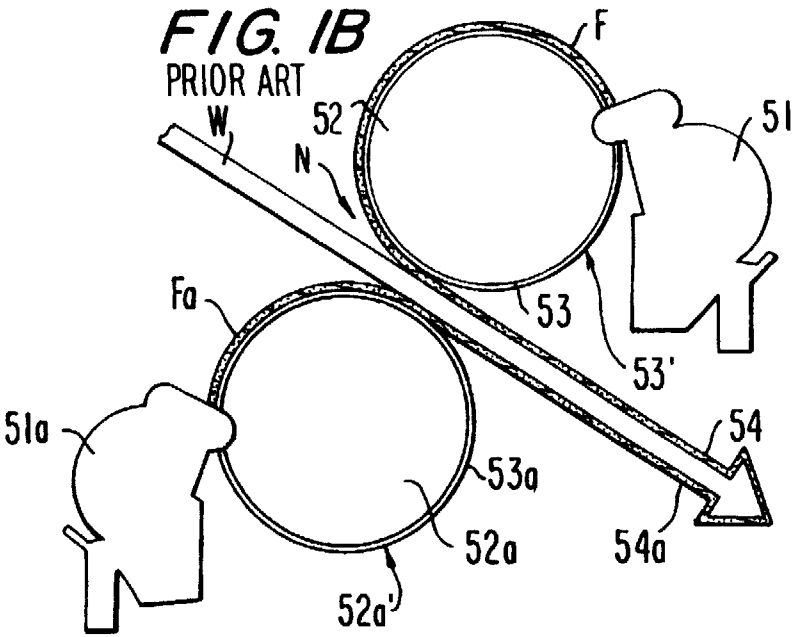
FIG. 1B PRIOR ART
FIG. 1 is an illustration showing the difference in coating quality between a prior art film press (right side) and a prior art blade coating apparatus (left side) as shown by the enlarged sectional view of the paper produced by each apparatus below the respective apparatus.
Figure 1D:
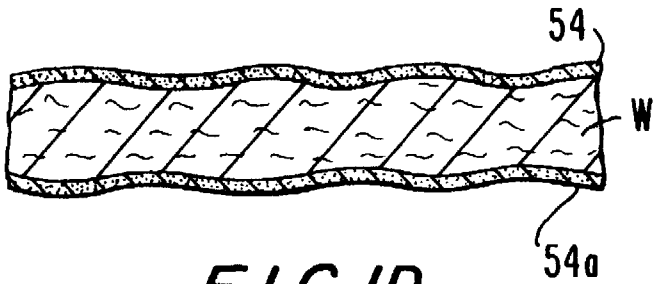
FIG. 1D PRIOR ART
Figure 1A:
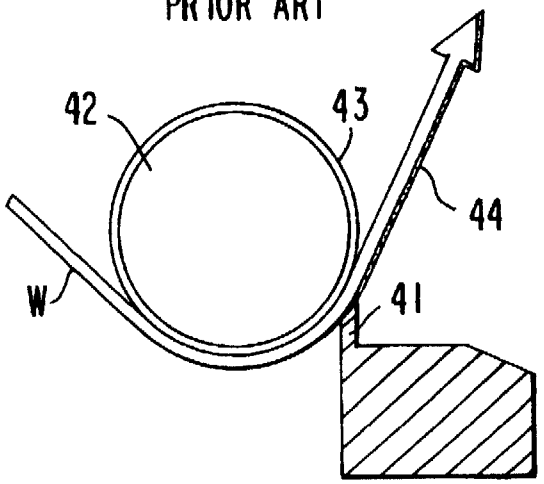
FIG. 1A PRIOR ART
Figure 1C:
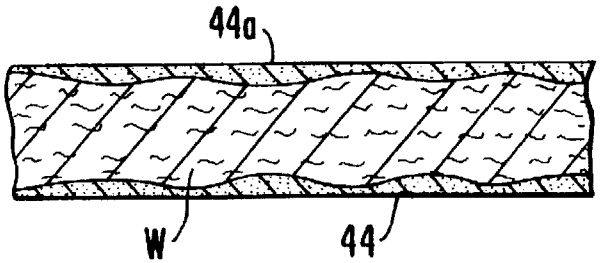
FIG. 1C PRIOR ART
Figure 2:
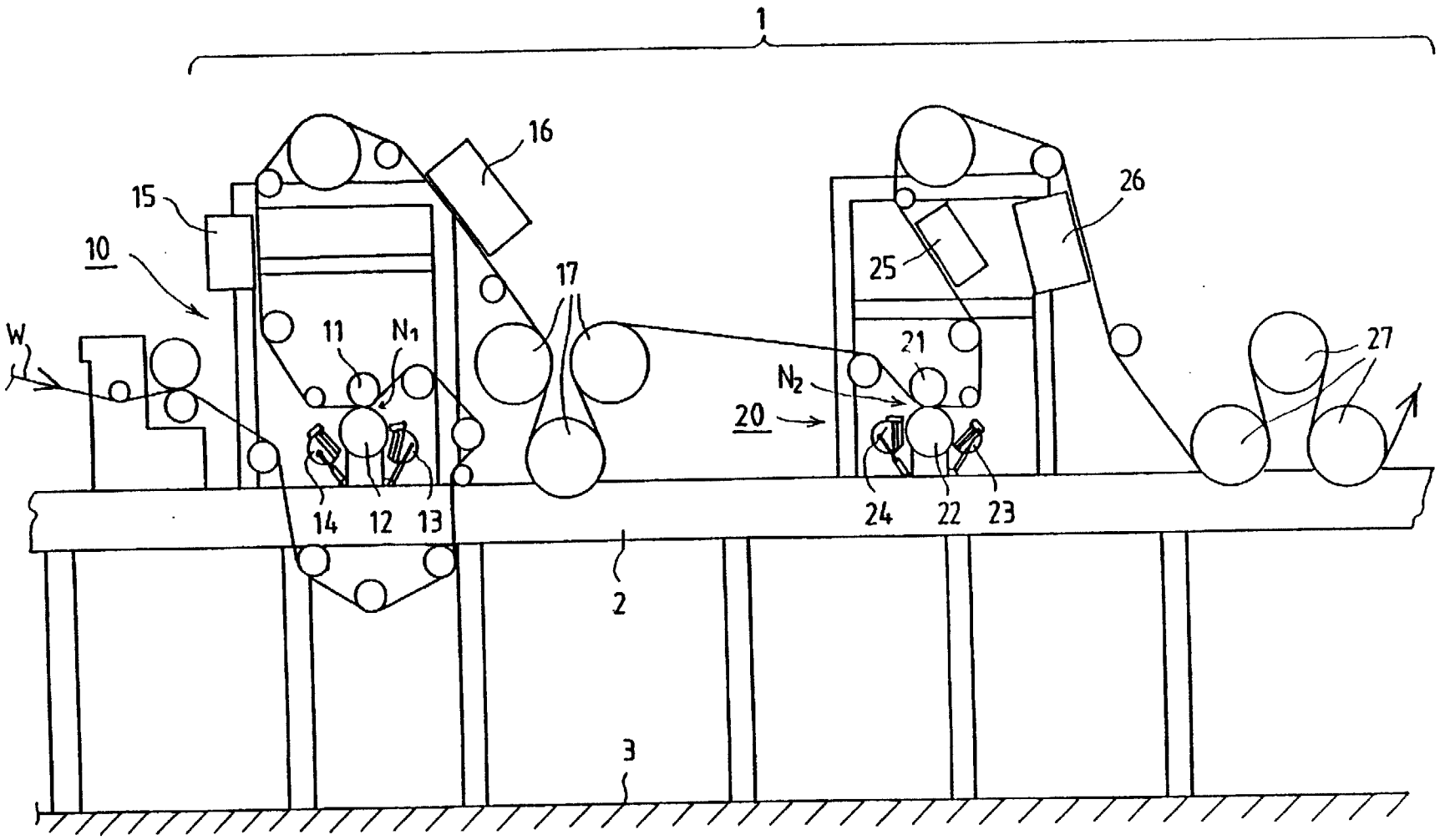
FIG. 2 is a schematic side view of a part of a paper machine, i.e. of a so-called coating part, which is provided with an equipment in accordance with the invention for two-sided coating of a paper web by means of film presses or, alternatively, by means of blade coaters.

Thus, FIG. 2 is a schematic side view of the coating part of a paper machine, which is denoted generally with the reference numeral 1. The reference numeral 2 denotes the frame of the paper machine, and the reference numeral 3 the base, such as the floor of the paper mill, on which the frame 2 is mounted. The coating part 1 in accordance with the invention comprises two coating stations placed one after the other in the running direction of the paper web W, the paper web W being coated in the first coating station 10 from the first side, and in the second coating station 20 from the second side, respectively. The coating unit in the first coating station 10 is a coating unit of the film press type, which comprises film press rolls 11, 12, which form a nip $N_1$ between them. The paper web W is passed into the nip $N_1$ in the way shown in FIG. 2, being guided by reversing and alignment rolls, and from the nip $N_1$ the paper web is passed to the first dryer unit, which consists of contact-free dryers, for example infrared dryers 15, 16, which dry the side of the paper web W that was coated in the first coating station 10, as well as of drying cylinders 17.

In the embodiment shown in FIG. 2, the second film press roll 12 of the first coating unit is provided with two coating devices 13, 14, of which, in the case shown in FIG. 2, the second coating device 14 has been pivoted to the opened position, while the first coating device 13 is in the running position, so that, by means of said first coating device 13, the coating agent is applied as a film onto the face of the second film press roll 12, from which it adheres to the paper web W in the roll nip $N_1$. Thus, in the illustration of FIG. 2, the mode of running that is used is the film press technique. The use, operation and selection of the mode of running of the coating devices 13, 14 will be described in more detail later, among other things, in relation to FIGS. 3 and 4.

After the drying cylinders 17 of the first drying unit, the paper web W is passed to the second coating station 20, in which the paper web W is coated from the second side. The coating unit in the second coating station 20 is also a coating unit of the film press type, which comprises film press rolls 21, 22, which form a nip $N_2$ between them, through which nip, with the running mode shown in FIG. 2, the paper web W is passed while guided by reversing and alignment rolls. In the way corresponding to the first coating station 10, in the second coating station 20 the second film press roll is also provided with two coating devices 23, 24, of which the first coating device 23 has been pivoted to the opened position, while the second coating device 24 is in the running position, so that the second coating device 24 spreads the coating-agent film onto the face of the second film press roll, from which the coating agent is transferred to the paper web W in the nip $N_2$ between the press rolls 21, 22. Thus, in the illustration of FIG. 2, the same running mode is employed in each coating station 10, 20. From the second coating station 20, the paper web W is passed to the second dryer unit, which consists of contact-free dryers, for example infrared dryers 25, 26, which dry the side of the paper web W that was coated in the second coating station 20, and of drying cylinders 27.

Figure 3:
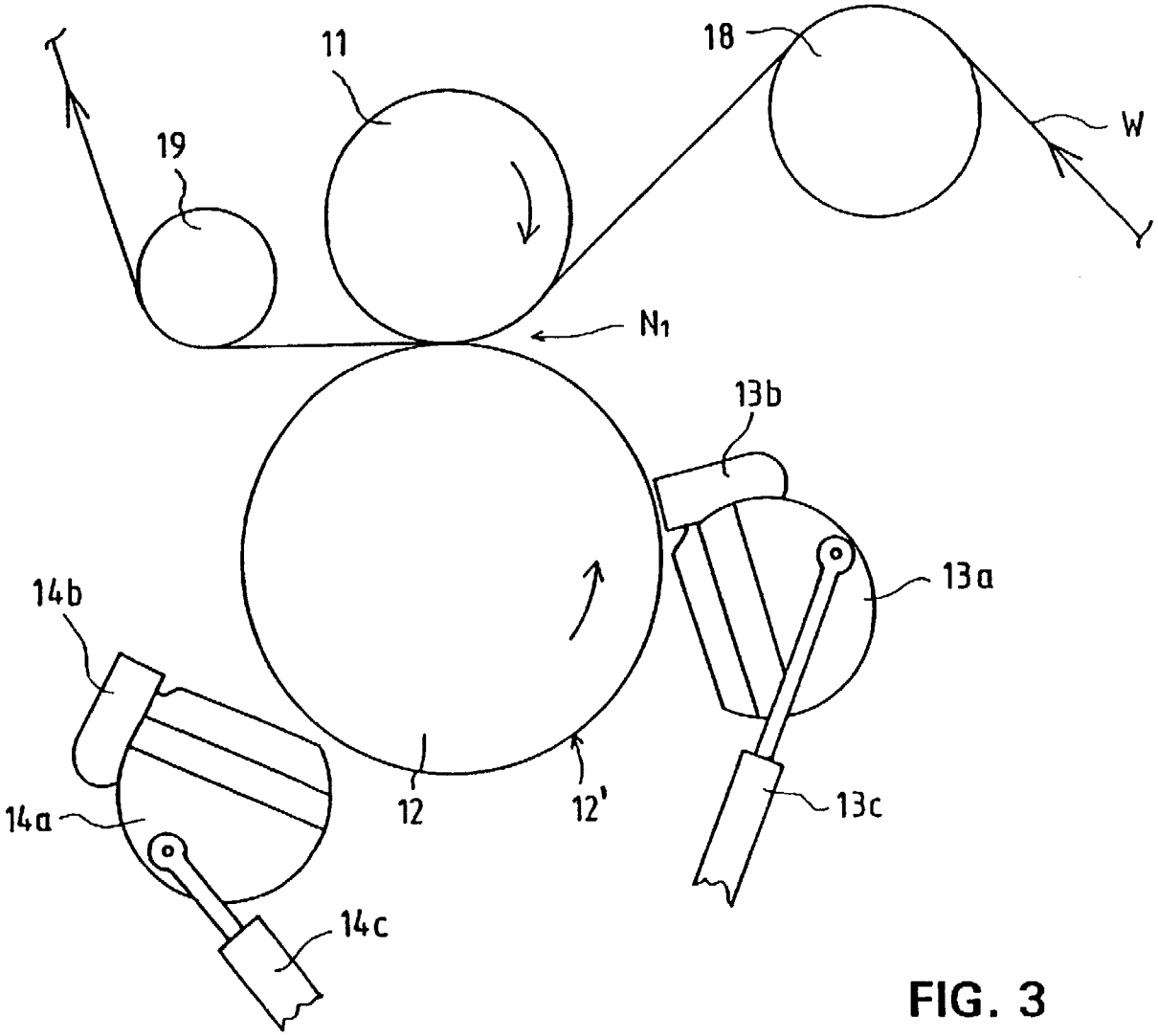
FIG. 3 is a more detailed schematic illustration of the first coating unit, which is placed in the first coating station of the equipment as shown in FIG. 2, when the film press technique is used as the running mode.
Figure 4:
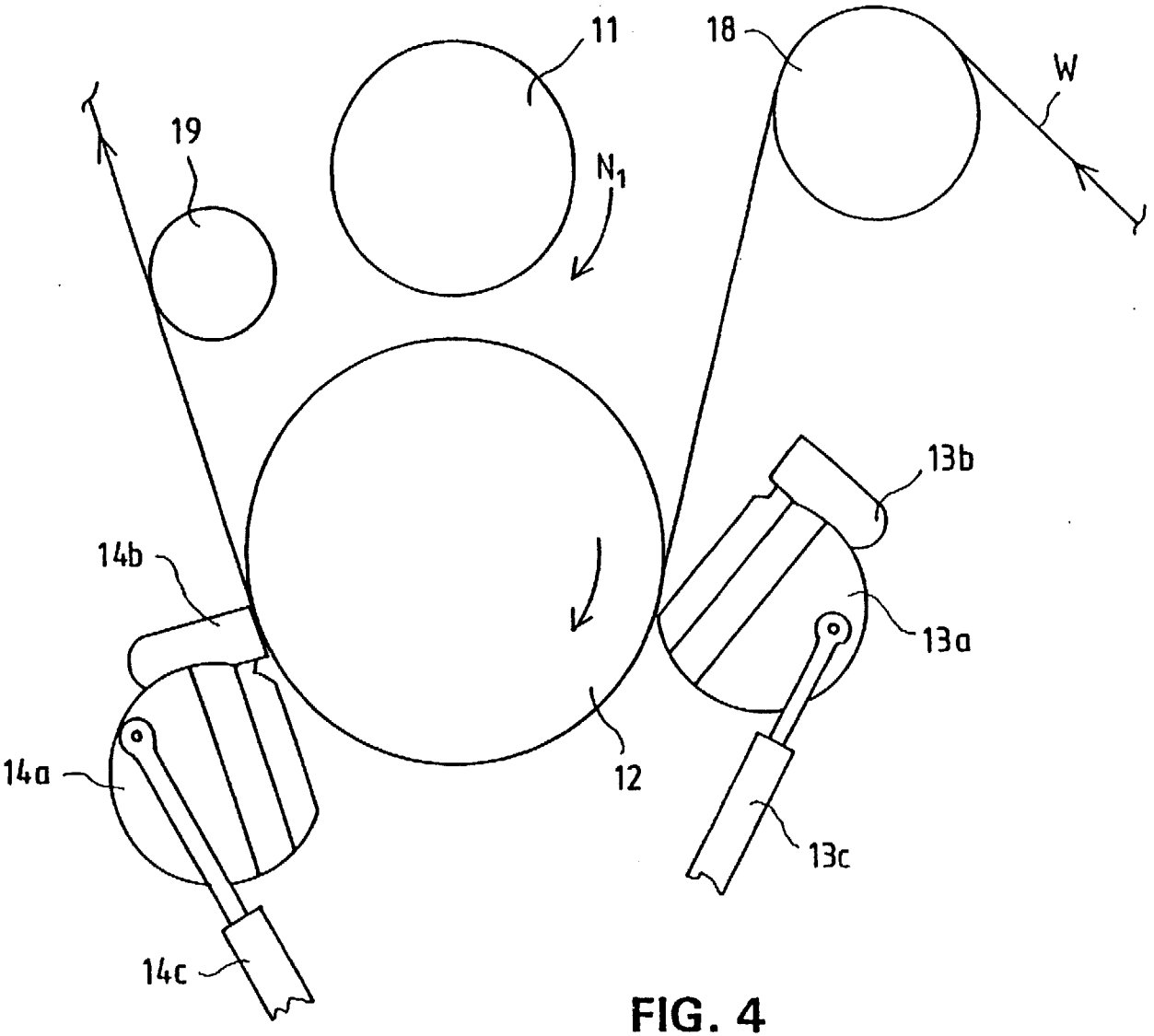
FIG. 4 is an illustration corresponding to FIG. 3 of the coating unit when the blade coating technique is used as the running mode.

FIGS. 3 and 4 are schematic illustrations corresponding to one another of alternative modes of running, which can be used in the coating stations 10, 20 of the coating part as shown in FIG. 2. FIGS. 3 and 4 are more detailed illustrations of the coating unit in the first coating station 10, but it is fully obvious that corresponding modes of running can also be used in the second coating station 20.

In the illustration of FIG. 3, the running mode that is used is the film press technique, in which the paper web W is passed through the nip $N_1$ between the film press rolls 11, 12 while guided and supported by the guide and alignment rolls 18, 19. With the mode of running of FIG. 3, in which the running takes place with the nip $N_1$ closed, a film of coating agent is applied by means of the first coating device 13 onto the face 12' of the second film press roll 12, which revolves at a circumferential speed substantially corresponding to the web W speed, from which face the coating agent is transferred onto the paper web W in the nip $N_1$. Of course, it is obvious that the first film press roll 11 also revolves at a corresponding circumferential speed.

In one-sided film-press coating, the second film press roll 12, onto which the coating agent is applied as a film, is provided with a resilient coating in the normal way, whereas the first film press roll 11, which operates as a back-up roll, is preferably a hard-faced roll, among other things, in view of easier cleaning and doctoring. The first coating device 13 is, for example, of a type as is described in the current assignee's earlier FI Patent Applications Nos. 925704 and 922331, comprising an application beam 13*a*, which is mounted pivotally on the frame of the film press or on a pivot arm (not shown) and which is provided with a coating head 13*b*. On the coating head 13*b*, as a doctor, for example, a large-diameter smooth rod as described in said Patent Applications Ser. Nos. 925704 and 922331 is used. The application beam 13*a* can be pivoted by means of pivot cylinders 13*c* between the running position shown in FIG. 3 and an open position. As was already described above, the second film press roll 12 is also provided with a second coating device 14, which comprises an application beam 14*a* provided with a coating head 14*b* and similarly linked pivotally and which can be pivoted by means of pivot cylinders 14*c* between the running position and the open position. With the mode of running shown in FIG. 3, the second coating device 14 remains pivoted in the non-operative open position.

In the illustration of FIG. 4, the mode of running that is used is the blade coating technique. First, in this mode of running, the nip $N_1$ between the film press rolls 11, 12 is open, and the paper web W has been passed by means of the guide and alignment rolls 18, 19 over the second film press roll 12, as a result of which the sense of rotation of said second film press roll 12 has been reversed, as is supposed to be indicated by means of the arrows in FIGS. 3 and 4. Thus, with the mode of running shown in FIG. 4, the first film press roll 11 is not in operation. Further, the illustration of FIG. 4 differs from that of FIG. 3 in the respect that the first coating device 13 has been pivoted to the non-operative open position, whereas the second coating device 14 has been pivoted to the running position, so that the coating agent is applied and evened by means of a coating doctor placed on the coating head 14*b* of the second coating device directly onto the paper web W. Thus, in this embodiment, said film press roll 12 operates as the back-up roll of the second coating device 14. As the coating doctor on the second coating head 14*b*, it is possible to use an ordinary blade or bar coater. In a way different from FIG. 4, the upper roll, i.e. the back-up roll 11 of the film roll 12, can also be used as the back-up roll of the blade coater 14. In such a case, of course, the transfer of the web W differs from that shown in FIG. 4.

Figure 5:
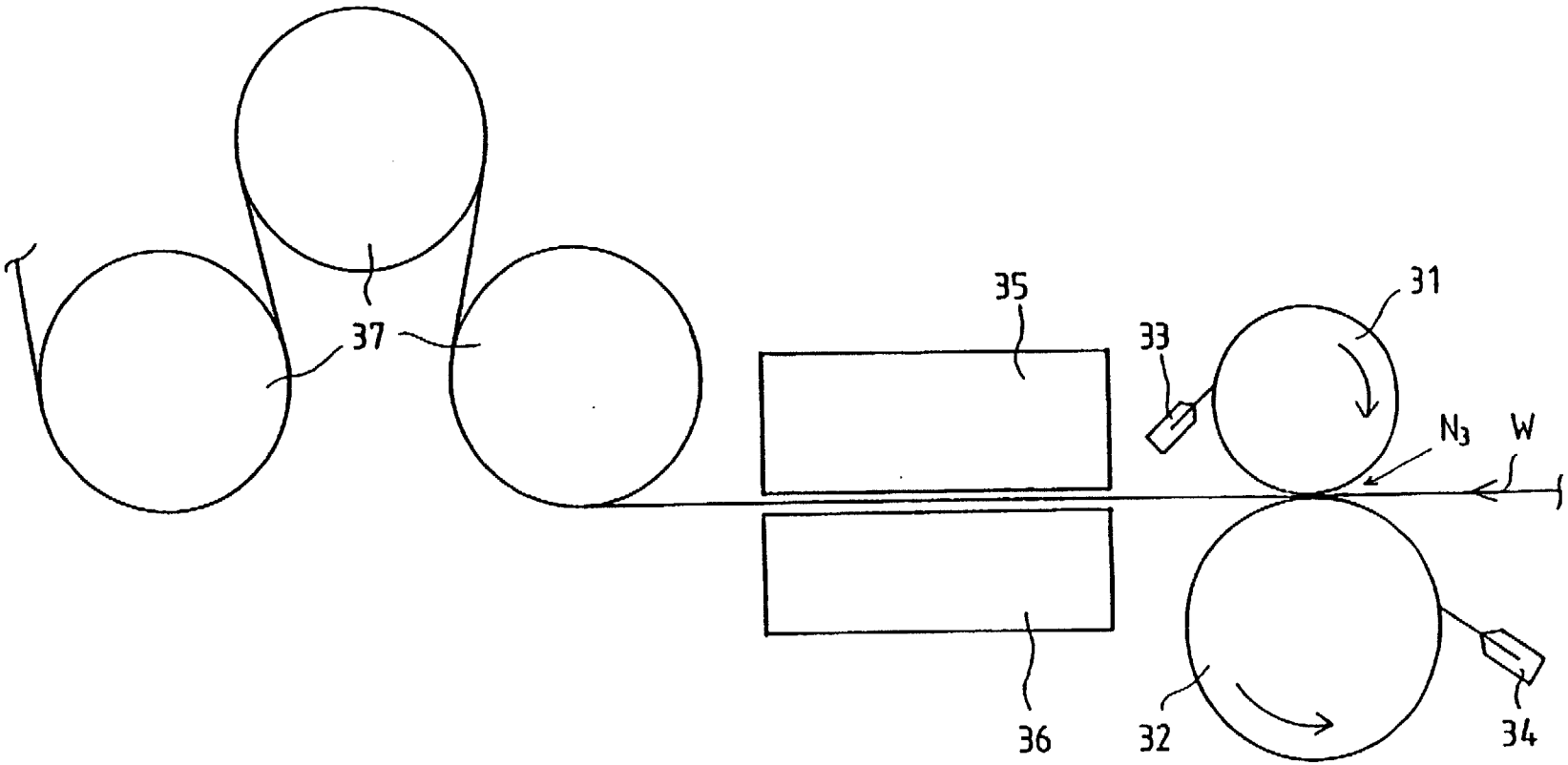
FIG. 5 shows an alternative further embodiment in which the paper web is coated or surface-sized from both sides by means of the same coating unit.

FIG. 5 shows a further alternative solution, in accordance with which the coating unit meant for carrying out the method of the present invention can be used. The coating unit as shown in FIG. 5 is a film press unit, which comprises the film press rolls 31, 32 which form the nip $N_3$ between them, through which nip the paper web W is passed. Each film press roll 31, 32 is provided with a coating device 33, 34, by whose means the films of coating agent are applied onto the faces of the rolls 31, 32. In the nip $N_3$, the coating-agent films are transferred onto both sides of the paper web. Thus, in the exemplifying embodiment shown in FIG. 5, two-sided coating is carried out by means of one and the same coating unit. This is why the run of the web differs from the embodiments described above, because, after the nip $N_3$, at both sides of the web, contact-free dryers are fitted, for example, infrared dryers 35, 36, which are followed by drying cylinders 37.

As was stated earlier, in one-sided film press coating, it is preferable to use a hard-faced roll as the back-up roll in a nip. Since, in two-sided film press coating, both press rolls must be provided with a resilient coating, this requires that, in connection with a change from one-sided film press coating or blade coating to two-sided film press coating, one of the rolls in the press must be changed if a hard-faced roll was used as said roll. In the coating part, if two-sided coating of the paper web W is carried out in the first coating station 10 in the way shown in FIG. 5, the coating unit of the second coating station 20 is switched out of operation, or one-sided coating of the paper web is carried out in it.

Irrespective of the mode of running, the composition, dry solids content, and viscosity of the coating paste that is used for coating can be the same both in blade coating and in film press coating. This is the case in particular when the large-diameter smooth coating bar described above is used as the coating doctor in film press coating. The dry solids content of the coating paste can be varied favourably within the range of 50 . . . 70%.

Above, the invention has been described by way of example with reference to the exemplifying embodiments illustrated in the accompanying figures. The invention is, however, not confined to the exemplifying embodiments described above alone, but different embodiments of the invention may show variation within the scope of the inventive idea defined in the accompanying patent claims.

We claim:

1. A coating station for coating one side of a web, comprising a film roll, the web being passed into engagement with said film roll, a back-up roll having a first position in nip-defining relationship with said film roll and a second position spaced from said film roll thereby not in nip-defining relationship with said film roll, and web coating means for coating the web, said web coating means comprising first coating means for spreading a film of coating agent onto a face of said film roll when said back-up roll is in said first position such that the film of coating agent is carried on the face of said film roll into the nip and transferred onto the web in the nip, and second coating means for spreading a layer of coating agent directly onto the web as it runs over a sector of said film roll when said back-up roll is in said second position.

2. The coating station of claim 1, wherein the direction of rotation of said film roll is adjustable such that when said web coating means are said first coating means and said back-up roll is in said first position, said film roll rotates in a first direction and when said web coating means are said second coating means and said back-up roll is in said second position, said film roll rotates in a second, opposite direction.

3. The coating station of claim 1, wherein said first coating means comprise a first coating device and said second coating means comprise a second coating device separate from said first coating device.

4. The coating station of claim 3, wherein said first and second coating devices are arranged in proximity to said film roll.

5. The coating station of claim 3, further comprising drying means for drying the web after it has been coated by said web coating means.

6. In a method for two-sided coating of a printing-paper web with a coating agent in which the paper web is passed through a coating part of the paper machine including first and second sequentially arranged coating stations, a first side of the web being coated with coating agent in the first coating station and a second side of the web being coated with coating agent in the second coating station, the web being passed through a first drying unit arranged after the first coating station and before the second coating station and in which a first layer of the coating agent produced on the first side of the web is at least partially dried, and the web being passed through a second drying unit arranged after the second coating station in which a second layer of the coating agent produced on the second side of the web is at least partially dried, the improvement comprising the steps of:

passing the web into contact with a first film press roll in each of the first and second coating stations, arranging a second film press roll at a distance from said first film press roll such that said second film press roll is movable to define a nip with said first film press roll through which the web is passed, and forming the first and second layers of coating agent on the respective side of the web by:

maintaining said second film press roll distanced from said first film press roll, passing the web over a circumferential segment of said first film press roll such that the respective side of the web is exposed, and arranging a coating blade device to apply the coating agent directly to the exposed side of the web in said circumferential segment of said first film press roll; or moving said second film press roll to define the nip with said first film press roll, passing the web through the nip such that the respective side of the web contacts said first film press roll, spreading the coating agent as a film onto a face of said first film press roll, rotating said first film press roll such that its circumferential speed is substantially equal to a running speed of the web, and transferring the film of coating agent from the face of said first film press roll in the nip between said first and second film press rolls to the respective side of the web.

7. The method of claim 6, wherein at least one of the first and second layers of coating agent is formed on the respective side of the web in the respective one of said first and second coating stations by arranging the second film press roll to define the nip with said first film press roll through which the web passes, spreading the coating agent onto the face of said first film press roll, rotating said first film press roll such that its circumferential speed is substantially equal to the running speed of the web, and transferring the coating agent from the face of said first film press roll in the nip between said first and second film press rolls to the web.

8. The method of claim 6, wherein at least one of the first and second layers of coating agent is formed on the respective side of the web by passing the web over the circumferential segment of said first film press roll in the respective one of said first and second coating stations, and arranging the coating blade device to apply the coating agent directly to the web in said circumferential segment of said first film press roll in the respective one of said first and second coating stations, further comprising the steps of:

rotating said first film press roll in a first direction of rotation when said second film press roll is spaced from said first film press roll and said nip is in an open position so that the web is directly coated as it runs over the circumferential segment of said first film press roll, and rotating said first film press roll in an opposite direction of rotation to the first direction of rotation when said second film press roll defines said nip with said first film press roll.

9. The method of claim 6, wherein both of the first and second layers of coating agent are formed on the respective side of the web by, in each of said first and second coating stations, arranging said second film press roll to define the nip with said first film press roll, the web being passed through said nip, spreading the coating agent onto the face of said first film press roll, rotating said first film press roll such that its circumferential speed is substantially equal to the running speed of the web, and transferring the coating agent from the face of said first film press roll in the nip between said first and second film press rolls to the web.

10. The method of claim 6, wherein both of the first and second layers of coating agent are formed on the respective side of the web by, in each of said first and second coating stations, passing the web over the circumferential segment of said first film press roll, and arranging the coating blade device to apply the coating agent directly to the web in said circumferential segment of said first film press roll.

11. The method of claim 6, wherein one of the first and second layers of coating agent is formed on the respective side of the web in the respective one of said first and second coating stations by arranging the second film press roll to define the nip with said first film press roll through which the web passes, spreading the coating agent onto the face of said first film press roll, rotating said first film press roll such that its circumferential speed is substantially equal to the running speed of the web, and transferring the coating agent from the face of said first film press roll in the nip between said first and second film press rolls to the web, and the other of the first and second layers of coating agent is formed on the respective side of the web in the respective on of said first and second coating stations by passing the web over the circumferential segment of said first film press roll and arranging the coating blade device to apply the coating agent directly to the web in said circumferential segment of said first film press roll.

12. The method of claim 6, further comprising the step of utilizing a coating agent in the first and second coating stations having a dry solids content of from about 50% to about 70%.

13. The method of claim 6, further comprising the step of regulating the composition, dry solids content and viscosity of the coating agent.

14. In an arrangement for two-sided coating of a printing-paper web with a coating agent in a coating part of a paper machine including a first coating station for coating a first side of the web, a first drying unit arranged after the first coating station to at least partially dry a first layer of coating agent produced on the first side of the web in the first coating station, a second coating station arranged after the first drying unit for coating a second side of the web and a second drying unit arranged after the second coating station to at least partially dry a second layer of coating agent produced on the second side of the web in the second coating station, the improvement comprising:

each of the first and second coating stations comprising a coating unit including a film roll, a back-up roll and at least one coating device associated with said film roll, said back-up roll having a first position in nip-defining relationship with said film roll and a second position spaced from said film roll thereby not in nip-defining relationship with said film roll, and guide means for guiding the web through the nip defined between said film roll and said back-up roll when said back-up roll is in said first position such that said at least one coating device applies the coating agent onto a face of said film roll, the coating being transferred from said face of said film roll in the nip onto the web, or for guiding the web over a circumferential segment of said film roll when said back-up roll is in said second position such that said at least one coating device applies the coating agent directly to the web in said circumferential segment of said film roll.

15. The arrangement of claim 14, wherein said guide means are structured and arranged to guide the web over the circumferential segment of said film roll while said back-up roll is in said second position, said coating device being a blade coater, said film roll being rotated in a first direction of rotation when said back-up roll is in said second position so that the web is directly coated as it runs over the circumferential segment of said film roll, and said film roll being rotated in an opposite direction of rotation to the first direction of rotation when said back-up roll is in said first position.

16. The arrangement of claim 14, wherein each of said coating units comprises two coating devices.

17. The arrangement of claim 16, wherein both of said coating devices of the same coating unit are associated with a common film roll.

18. The arrangement of claim 16, wherein a first one of said coating devices in each of said coating units is operable if the web is guided by said guide means over the circumferential segment of said film roll in the respective one of said coating units and a second one of said coating devices in each of said coating units is operable if the web is guided by said guide means through the nip defined between said film roll and said back-up roll in the respective one of said coating units when said back-up roll is in nip-engagement with said film roll.

19. An arrangement for two-sided coating of a printing-paper web with a coating agent in a coating part of a paper machine, comprising a coating station for coating both sides of the web, said coating station comprising first and second film press rolls arranged to define a nip through which the web passes, first and second coating devices associated with a respective one of said first and second film press rolls for applying coating agent onto the respective one of said first and second film press rolls, the coating agent being transferred from the first and second film press rolls to a respective side of the web in the nip, said first and second film press rolls being arranged vertically one above the other such that the web passes in a substantially horizontal direction through the nip, and a drying unit arranged after said coating station to at least partially dry the coating agent applied onto the sides of the web in said coating station.

* * * * *